United States Patent [19]

Pinson et al.

[11] 4,372,216

[45] Feb. 8, 1983

[54] DISPENSING SYSTEM FOR USE ON A CARRIER MISSILE FOR REARWARD EJECTION OF SUBMISSILES

[75] Inventors: George T. Pinson; Alex B. Hunter, both of Huntsville, Ala.

[73] Assignee: The Boeing Company, Seattle, Wash.

[21] Appl. No.: 107,023

[22] Filed: Dec. 26, 1979

[51] Int. Cl.[3] ..... F42B 13/50; F42B 25/16

[52] U.S. Cl. ..... 102/489; 102/393

[58] Field of Search ..... 102/7.2, 61, 56 R, 69, 102/393, 394, 473, 480, 489

[56] References Cited

U.S. PATENT DOCUMENTS

| | | | |
|---|---|---|---|
| 3,185,097 | 5/1965 | Cushing et al. | 102/7.2 |
| 3,534,653 | 10/1970 | Specht et al. | 102/7.2 |
| 3,712,229 | 1/1973 | Schock | 102/69 |

*Primary Examiner*—Charles T. Jordan

*Attorney, Agent, or Firm*—Cole, Jensen & Puntigam

[57] ABSTRACT

The system includes an elongated support structure positioned substantially central of the carrier missile, wherein the support structure includes a gas-actuated piston-like device which moves between a start position and an extended position. A series of elongated launch tubes, in which submissiles are positioned, are arranged around, and parallel to, the support structure. The forward end of each launch tube is pivotally connected to the central support structure. The other end of each launch tube is connected to the piston-like device through levers which are hinged at both ends, so that as the piston-like device moves, the rear end of the launch tubes move radially relative to the support structure, so that the launch tubes are at an angle relative to the carrier missile. In this position, the submissiles in the launch tubes may be ejected rearwardly of the carrier missile by an explosive charge or similar means.

10 Claims, 9 Drawing Figures

Fig. 1
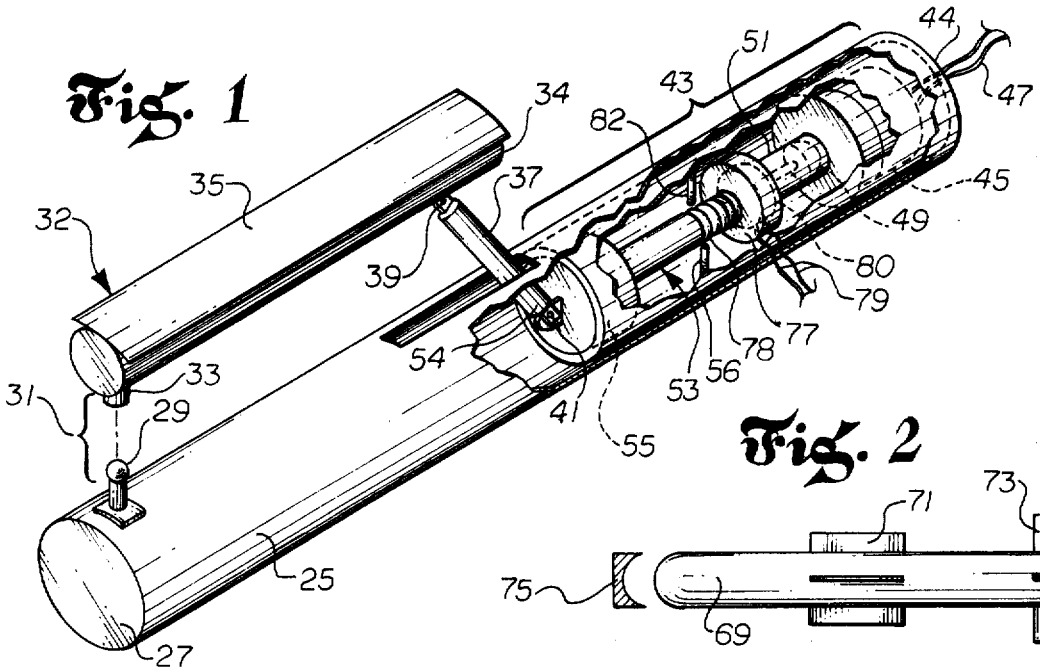
Fig. 2
Fig. 3
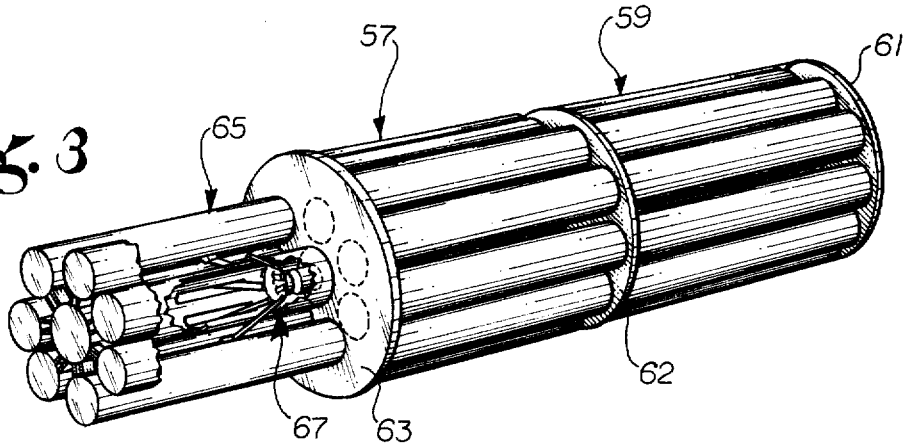
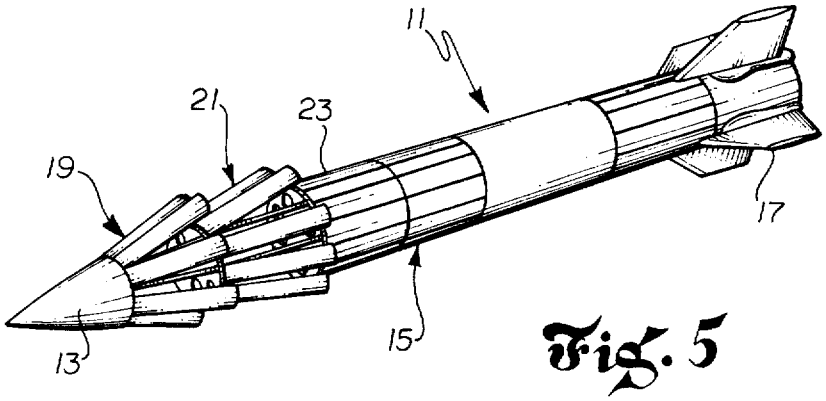
Fig. 5

SUBMISSILE PRE-DEPLOYMENT COMMANDS
SINGLE SUBSYSTEM
84
EXPULSION CHARGE AND FUSE
80
83
DEPLOYMENT CONDITIONS SATISFIED
MICROPROCESSOR
DEPLOYMENT SEQUENCING
POWER SUPPLY
HOT GAS GENERATOR TO OPEN
45
FIRING SEQUENCE COMMANDS
HOT GAS GENERATOR TO CLOSE
77

DISPENSING SYSTEM FOR USE ON A CARRIER MISSILE FOR REARWARD EJECTION OF SUBMISSILES

BACKGROUND OF THE INVENTION

The present invention relates generally to the missile art, and more specifically concerns a system for ejection of submissiles from a carrier missile.

Conventional missiles typically include a single warhead which is carried to a target. A single warhead missile, however, is subject to conventional missile defenses, and usually can only cover a rather limited, concentrated target area. For these reasons, there has been a considerable amount of development in missiles which are capable of carrying multiple warheads or submissiles, each of which may be independently targetable. The multiple submissiles in such a carrier missile can be deployed to a plurality of targets, over several different routes, making such a missile very difficult to defend against.

A variety of problems are presented by such a system, however, and numerous operational parameters, including the velocity, attitude, altitude, size, weight and volume of the missile system, and the desired characteristics of submissile flight such as pattern density, orientation and line of fall, must be considered and overcome.

The principal problem, however, concerns the dispersing of the submissiles from the carrier missile. Various dispersing systems are known for such a purpose, although they generally fall into three classes: self-dispersion, centrifugal dispersion, and powered dispersion. In self-dispersion, the submissiles are not physically attached to the carrier missile, but are carried along by the carrier missile in its flight. The speed of the carrier missile is reduced at a selected point, and the momentum of the submissiles, together with the action of gravity, results in the expulsion of the submissiles from the front of the missile. Self-dispersion systems are unpredictable, however, due to the wide range of possible orientations of the carrier missile and is virtually unworkable at supersonic speeds, since the submissiles cannot penetrate the strong shock wave at the front of the carrier missile.

In centrifugal dispersion, the carrier missile is rotated at a sufficient rate to release the submissiles. However, the systems necessary to effect the centrifugal dispersion substantially increase the weight and expense of the missile system, and are therefore considered to be impractical.

In powered dispersion, the submissiles are ejected from the carrier missile by an independent power source. There are various types of powered dispersion techniques. The submissiles may be dispensed rearwardly, forwardly, or radially of the carrier missile. Examples of powered dispersing systems include a pressurized bladder system which ejects the submissiles radially when inflated; a sequence dispenser, in which submissiles are ejected at high speed forwardly of the carrier in a prescribed sequence; an asymmetric dispenser, in which the nose cone of the carrier missile is ejected and the individual submissiles are then launched from tubes; and an explosive dispenser, in which the submissiles are blasted away radially from the carrier missile.

Although one or more of the above techniques have proven to be effective with small munitions, i.e. those under three kilograms, none of the above techniques have proved workable with heavier submissiles, particularly when the carrier missile is moving at supersonic speeds. Typically, the submissiles are unstable when ejected at supersonic speeds; as a result, they often impact each other and the carrier missile itself. The flight of the carrier missile itself is also usually seriously affected, thereby disturbing the release of subsequent submissiles.

Accordingly, it is a general object of the present invention to provide a submissile dispensing system for use on a carrier missile which overcomes one or more of the disadvantages of the prior art noted above.

It is another object of the present invention to provide such a dispensing system which can eject submissiles when the carrier missile is traveling at supersonic speeds.

It is an additional object of the present invention to provide such a dispensing system which can eject submissiles without substantially affecting the stability of the carrier missile.

It is a further object of the present invention to provide such a dispensing system which can eject submissiles without substantially disturbing the pattern of the airflow around the carrier missile.

It is yet another object of the present invention to provide such a dispensing system which can eject submissiles so that they are stable upon ejection and can thereafter be controlled independently.

It is a still further object of the present invention to provide such a dispensing system which can be deployed and then returned to its original orientation in the carrier missile.

SUMMARY OF THE INVENTION

Accordingly, the present invention includes at least one launch tube means which is adapted to carry a submissile therein, and a support means for the launch tube means. A first pivot means pivotally connects one end of the launch tube means to the support means, so that the launch tube means can pivot relative to the support means about the pivot means. An actuator means which moves between a start position and an extended position is also included as is a means for moving the actuator means between the start position and the extended position. A lever means is rotatably connected between said actuator means and the other end of the launch tube means, so that when the actuator means is in the start position, the launch tube means is in a stowed position, and when the actuator means is in the extended position, the launch tube means is in a position to eject the submissile therein.

DESCRIPTION OF THE DRAWINGS

A more thorough understanding of the invention may be obtained by a study of the following detailed description taken in connection with the accompanying drawings in which:

FIG. 1 is a perspective view showing schematically the dispensing system of the present invention.

FIG. 2 is a simplified diagram showing the configuration of a typical submissile used with the dispensing system of the present invention.

FIG. 3 is a perspective, partially cutaway, view of a portion of a carrier missile showing three arrays of submissiles and their relationship to the dispensing system of the present invention.

FIG. 5 is a perspective view of a carrier missile showing two arrays of submissiles in an eject configuration.

DESCRIPTION OF THE PREFERRED EMBODIMENT

Figure 6:
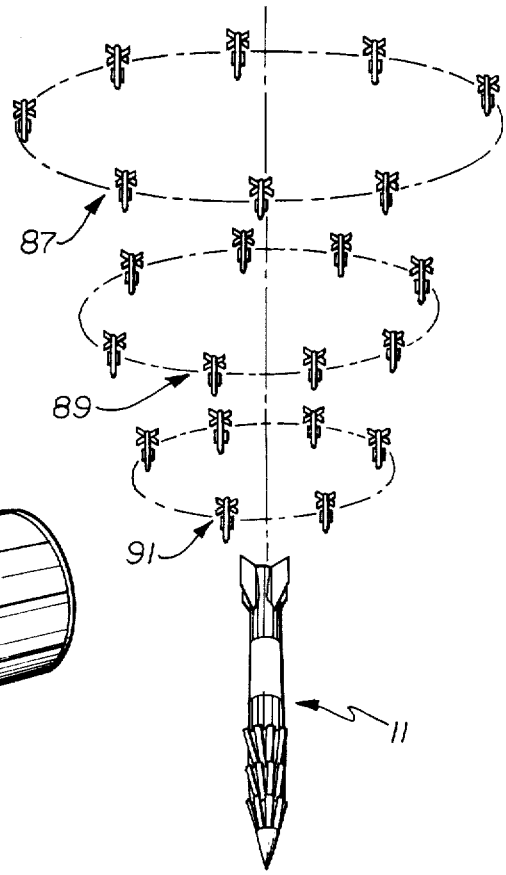
FIG. 6 is a pictorial view showing a carrier missile and a plurality of submissiles which have been deployed from the carrier missile.

The present invention is a dispensing system for ejecting submissiles from a carrier missile. FIG. 5 shows in general the configuration of the dispensing system relative to the carrier missile. A conventional elongated carrier missile generally shown at 11 comprises a conical nose section 13, a generally cylindrical body section 15, and a finned tail section 17. The body section 15 includes a plurality of arrays of launch tubes in which submissiles are positioned. Two launch tube arrays 19 and 21 are shown in an eject position or configuration while a third array 23 is shown in a stowed position. Each launch tube array comprises a series of launch tubes arranged around the circumference of the body section 15 in a stowed position. The metal skin of the carrier missile is secured in portions to the launch tubes to form the exterior surface of body section 15 in the area where the arrays are located.

Each launch tube contains a submissile which is ejected from the launch tube rearwardly of the carrier missile by an explosive charge or similar means when the launch tube is in its eject position, at a specified angle relative to the centerline of the carrier missile 11. When ejected, the submissiles are oriented generally parallel to the airflow field around the carrier missile, at an angle which is less than the shock wave angle off the front of the missile. The initial velocity of the submissiles is sufficient to carry them away from the influence of the carrier missile, without affecting the flight of the carrier missile. The submissiles are also sufficiently stable following ejection that their onboard control system can initiate and maintain control of the submissile over an independent flight path.

FIG. 1 shows in more detail the dispensing system of the present invention. Each launch tube array has one dispenser, for as many as 10 or 12 launch tubes. However, for purposes of clarity of explanation, the dispensing system of FIG. 1 is shown with only a single launch tube. Each dispensing system includes an elongated support structure 25 which typically extends the entire length of the launch tube array with which it is associated. The support structure 25 is in the embodiment shown, a hollow metal cylinder, closed at both ends, having a diameter of 6 inches, for a carrier missile diameter of 16 inches. These dimensions are of course for illustration purposes only and are not critical to the invention.

At the forward end 27 of support structure 25 on the curved surface thereof is positioned a base portion 29 of a hinge 31 which pivotally connects a launch tube 32 to the support structure 25. The mating upper portion 33 of the hinge is positioned on launch tube 32 near the forward end thereof. In the embodiment shown, the base portion 29 of the hinge 31 is an upstanding cylindrical section approximately 3 inches high topped with a round ball approximately 1 inch in diameter. The mating upper portion 33 is a hollow cylindrical section having an interior element which permits passage of the base portion 29 therein to form a pivotal connection. The launch tube 32, which in the embodiment shown is approximately 4 inches in diameter, thus can pivot toward and away from the support structure 25 about the hinge 31.

In the embodiment shown, the launch tube 32 is approximately 24 inches long and holds a submissile therein. Secured to the exterior surface of each launch tube is a rectangular, curved section 35 of the exterior surface of the carrier missile. When all of the launch tubes in a particular launch tube array are in their stowed positions, the plurality of surface sections secured to the launch tubes mate together along their longitudinal edges to form a continuous exterior surface for the carrier missile in the area where the array is located.

Near the rear end of the launch tube 32 is an elongated launch tube lever 37 which is pivotally connected at one end to the rear of launch tube 32 through a hinge connection 39, and is pivotally connected to a system actuating mechanism shown generally at 43 through a hinge connection 41.

The actuating mechanism 43 is positioned interiorily of the hollow support structure 25, towards the rear thereof. At the rear end of the actuating mechanism 43 is a first hot gas generator 45, which is ignited through wires 47 which extend from the rear of the support structure 25. The hot gas generator is a conventional, known device, which upon ignition produces a gas which is directed against the backside of an actuator piston 49. The actuator piston 49, which is positioned within a piston tube 51, is moved forwardly by the pressure of the gas against an actuator rod 53, which also moves forwardly. At the front end of actuator rod 53 is a cylindrical base 55 which substantially fills the interior of the support structure 25. The base 55 moves forwardly within the support structure as the piston tube 51 and the actuator rod 53 move forward together under the pressure from the gas produced by the gas generator 45. A pawl 56, operating on a portion of a ratchet gear 78 in actuator rod 53, holds the actuating mechanism in the most forward position.

The launch tube lever 37 is pivotally secured to the front end of base 55 in approximately the center thereof through the hinge connection 41. A small protrusion extends from the base 55, and a mating section extends from the end 54 of the launch tube lever 37; these two sections are joined in a pivoting relationship by a pin.

The forward movement of base 55 moves the end 54 of the launch tube lever 37 forwardly, pivoting the launch tube lever from a first position in which the launch tube lever is at a relatively small angle relative to the support structure 25 to a second position in which it is at a substantial angle relative thereto. As the launch tube pivots, the rear end 34 of the launch tube 32 moves outwardly from the support structure 25 about hinge 31. In the embodiment shown, when the base 55 of the actuator lever is at its most forward position, the launch tube is at an angle which is less than the shock wave angle off the front of the missile. In one embodiment, a launch tube angle of 13° will suffice.

All of the launch tubes in a particular array will usually be attached to a single dispensing system so that each array of launch tubes will simultaneously move from a stowed position to an eject position, at the desired angle, i.e. approximately 13°, relative to the centerline of the carrier missile. FIG. 5 shows the appearance of a three array carrier missile when the first two arrays are in the eject position, and the third rear array is in a stowed position.

FIG. 3 shows in somewhat more detail a portion of the structure of FIG. 5. In FIG. 3, submissile arrays 57 and 59, which are the two rear arrays, are shown in a stowed position, without the exterior surface sections. The three arrays are separated by lateral array plates 61–63. Each array has its own dispensing system, although the dispensing system for arrays 57 and 59 are not shown in FIG. 3. In the embodiment of FIG. 3, seven launch tubes are shown in the first array. It should be understood, of course, that a different number of launch tubes, as well as different number of arrays, can be accommodated in a carrier missile, using the principles of the present invention.

Array 65 in FIG. 3 is the forwardmost array, and three launch tubes are cut away to show generally the actuating mechanism 67. This actuating mechanism 67 is identical to that shown in FIG. 1, except that all seven launch tubes in array 65 have a hinge connection to the forward base portion of the actuating mechanism. All of the launch tubes in FIG. 3 are shown in the stowed position. Each launch tube will have stored therein a submissile, such as that shown in FIG. 2. The submissile of FIG. 2 has an elongated body 69, with radial stabilizing wings 71 located approximately midlength, and tail fins 73. The submissiles in the embodiment shown can be fairly large, weighing approximately 9 kilograms, but, of course, the size of the submissiles can vary greatly, depending on the application.

When a submissile is positioned in its launch tube, the nose of the submissile rests against a forward dome protector 75, which is configured to mate with the front end of the submissile. Forward of the dome protector 75 is an expulsion charge and fuse and associated wiring (not shown) which, when activated, blasts against the forward dome protector 75, forcing the dome protector and the submissile out of the launch tube.

Figure 4:
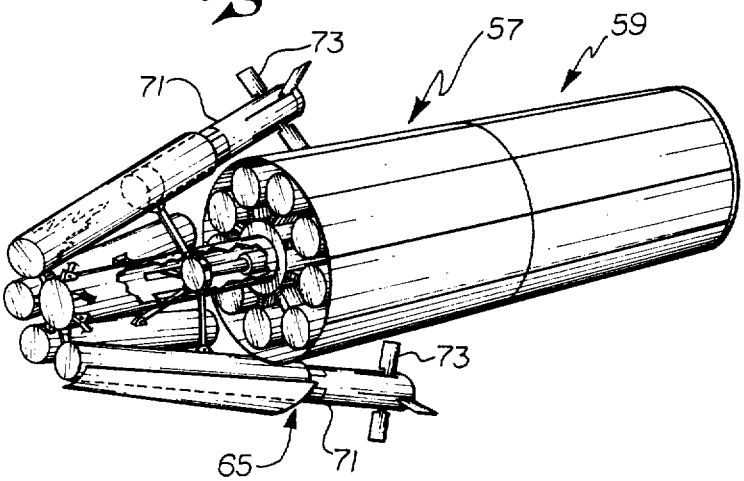
FIG. 4 is a perspective view of a portion of a carrier missile showing several of the launch tubes and their associated submissiles comprising a first submissile array in an eject configuration.

FIG. 4 is somewhat similar to FIG. 3, but shows the launch tubes in the first array 65 in an eject position, with the submissiles having been fired, but only partially deployed. Arrays 57 and 59 are shown in their stowed position, with their surface sections in place. As the submissiles leave their launch tubes, the tail fins 73 and wings 71, which have been in a stowed position in the submissile, open automatically upon clearance of the launch tubes, as shown in FIG. 4.

After the submissiles in a particular array have been fully deployed, the launch tubes in the array are moved back to a stowed position. Referring again to FIG. 1, the pawl 56 is released and a second gas generator 77, located around actuator rod 53, is used to return the launch tube 32 to its stowed position. The operation of the second gas generator is initiated through wires 79. The resulting gas from ignited gas generator 77 acts on a front plate 80 of the actuator piston 49, forcing it back toward the rear of the support structure, to its original position. When actuator piston 49 reaches its original position, launch tube 32 is again in its fully stowed position, with the exterior sections of the carrier missile secured to the launch tubes mating together to form a continuous exterior surface. A pawl 82, acting on another portion of ratchet mechanism 78 prevents the launch tubes from again being moved to the eject position after once having been deployed and then returned to the stowed position.

The actuating mechanism 43 may take other forms. For instance, a pneumatic apparatus, with internal locking feature may be used in place of the apparatus described above.

Figure 7:
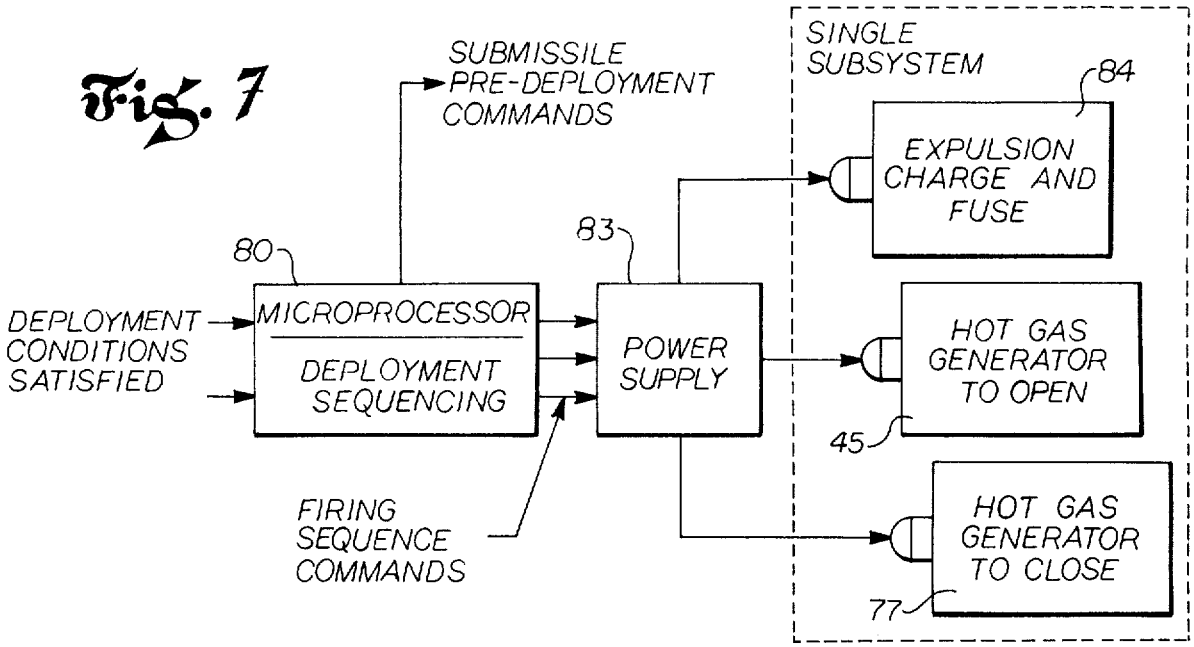
FIG. 7 is a block diagram showing the basic control system of the dispensing means of the present invention.

The above described sequence of operations may be controlled electrically through a series of timers or by a microprocessor, such as shown in FIG. 7. When the conditions are correct for deployment, i.e. at the correct time in the flight of the carrier missile relative to particular targets, a microprocessor 80 initiates a programmed sequence of signals to power supply 83 which in turn provides signals in the desired squence to the first hot gas generator 45 to move the launch tubes in a particular array to an eject position, then to the expulsion charges 84 in each launch tube for ejection of the submissiles, and then to the second hot gas generator 77 to move the launch tubes back to their stowed position.

Figure 8A:
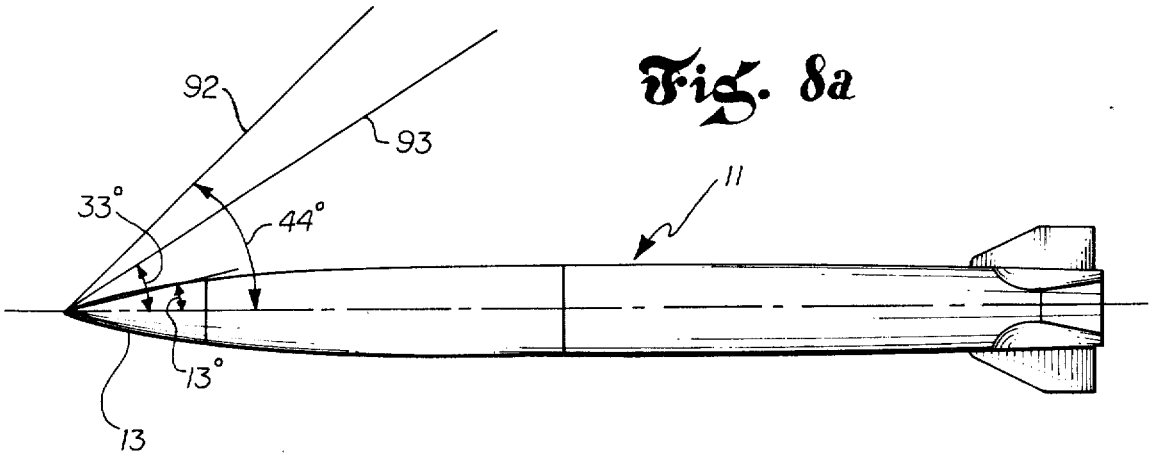
FIG. 8*a* is a schematic view showing the airflow shock effect for the carrier missile before the submissiles have been positioned in the eject configuration.

When the launch tubes are deployed at the proper eject angle to the rear of the carrier missile, the launch tubes and submissiles therein become essentially an extension of the body of the carrier missile for purposes of airflow analysis. This minimizes the tendency toward instability of both the carrier missile and the submissiles in the firing sequence. FIG. 8*a* shows the configuration of a typical carrier missile with a nose angle of approximately 13°, before movement of the launch tubes to the eject position, and examples of frontal shock waves therefore. The angle of the frontal shock wave off the missile will depend upon the speed of the missile, as well as the configuration of the nose of the missile. For a mach number of 1.5, for instance, the angle of the shock wave is 44° (line 92) relative to the centerline of the missile, while for a mach number of 2.0, (line 93) the angle of the shock angle decreases to 33°. Shock wave angles of as small as 15° are not uncommon for missiles, however.

Figure 8B:
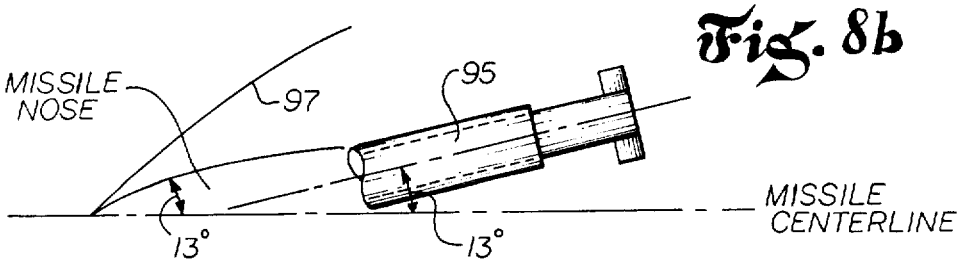
FIG. 8*b* is a schematic view showing the airflow shock effect for the carrier missile after the submissiles have been positioned in the eject configuration.

When a launch tube 95 is deployed to an eject position, such as shown in FIG. 8*b*, which is at an angle of approximately 13°, relative to the centerline of the missile, approximately the same or slightly less than the nose angle of missile 11, the launch tube is well within the shock wave line 97 and essentially forms an extension of the nose section of the carrier missile, as shown in FIG. 8*b*. As mentioned above, it is very important the angle of ejection be less than the shock wave angle. Further, the ejection of the submissile should be as near parallel as possible to the airstream flow which initially is approximately equal to the nose angle but then bends back slightly toward the missile aft of the nose area.

The submissile is ejected from the launch tube with a velocity vector which is esentially parallel to the velocity vector of the local airstream off the nose of the carrier missile. Thus, the submissiles are relatively stable after being ejected from the launch tubes, and since the wings and fins on the submissiles are automatically deployed upon ejection, the submissiles may be independently and accurately directed to different targets.

Also, the launching of submissiles in the system described above results in a minimum effect on the stability of the carrier missile, so that it can continue accurately on its intended flight. Thus, relatively large submissiles, on the order of 3 kg and greater, may be rapidly deployed in sequential arrays, at supersonic, as well as subsonic, speeds, without affecting the stability of the carrier missile. If the submissiles have an onboard control system, each submissile is an independently targetable vehicle which can be directed to a unique target along a unique preselected path.

The launch tubes in each array will, when in the eject position, project radially from the centerline of the carrier missile at the specified angle. There is thus a specific angle between the launch tubes around the array. This arrangement will further reduce the chance of contact between the submissiles as they are ejected from the launch tubes.

Further, the submissiles can be deployed in a particular sequence to reduce the vibration effect on the carrier missile during launch operations. For instance, in a ten submissile array, the ejection of missiles 1, 3, 5, 7 and 9 in a first round, followed by ejection of submissiles 2, 4, 6, 8 and 10 in a second round will tend to minimize the vibration problem, and also assists in the stability of the carrier missile and reduction of the carrier missile control problems.

In addition, a nylon blanket or metal web, secured between adjacent launch tubes, can be used to reduce the airflow disturbance effect on the launch tubes for the short period of time required for the ejection of the submissiles. When the launch tubes are moved to their eject position, the nylon or metal web stretches relatively taunt between them, thus maintaining the position of the launch tubes relative to each other and the carrier missile. This also tends to reduce the vibration of the launch tubes and the subsequent effect on the carrier missile.

FIG. 6 shows a typical deployment pattern for three arrays of submissiles from a single carrier missile. In FIG. 6, the carrier missile 11 is shown in a downward portion of its flight; its three arrays of submissiles are shown as having been deployed, with array 87 being the first deployed, followed by arrays 89 and 91. Each deployed array of submissiles is arranged in a substantially oval pattern, forming rings of submissiles such as shown in FIG. 6. After the submissiles are deployed, as shown, the onboard control and guidance mechanisms of each submissile takes over control of the flight of the submissile and directs the submissile to a particular defined target. The multiple submissiles can be used to thoroughly cover a large surface target, or can be deployed to different targets, or to the same target over different routes. Such a multiple submissile system thus is capable of foiling conventional defenses set up for single warhead missiles.

Thus, a system has been shown and described which is capable of dispensing large submissiles from a carrier missile at supersonic speeds without substantially affecting the stability of the carrier missile itself. The submissiles are dispensed in such a way that they have sufficient stability upon deployment that they may be in turn readily controlled by an internal guidance system and directed to particular targets. Following deployment of the arrays of submissiles, the launch tubes in the carrier missiles may be moved back to their stowed position, so that the carrier missile can thereafter continue along its intended flight path without the effect caused by the deployed launch tubes.

Although a preferred embodiment of the invention has been disclosed herein for purposes of illustration, it should be understood that various changes, modifications, and substitutions may be incorporated in such embodiment without departing from the spirit of the invention as defined by the claims which follow.

We claim:

1. An apparatus for ejecting submissiles from a carrier missile, comprising:

at least one launch tube means adapted to carry a submissile;

a support means;

first pivot means, connecting one end of said launch tube means to said support means;

actuator means which moves between a start position and an extended position;

lever means rotatably connected between said actuator means and the other end of said launch tube means; and means for moving said actuator means between said start position and said extended position such that when said actuator means is in the start position, said launch tube means is in a stowed position, and when said actuator means is in the extended position, said launch tube means is in a position to eject the submissile therein.

2. An apparatus of claim 1, wherein the eject position of said launch tube means is such that the submissile is launched rearwardly of the carrier missile.

3. An apparatus of claim 2, wherein said launch tube means, when it is in the eject position, is at an angle relative to the centerline of said carrier missile which is less than the angle of the shock wave off said carrier missile.

4. An apparatus of claim 3, wherein said angle is approximately 13°.

5. An apparatus of claim 1, wherein a section of the exterior surface of the carrier missile is secured to said launch tube means so that when said launch tube means is in the stowed position, a continuous surface is presented for said carrier missile.

6. An apparatus of claim 1, wherein said actuator means is capable of moving in both directions between the start position and the extended position, and wherein said moving means includes means for moving the actuator means from the start position to the extended position and from the extended position to the start position.

7. An apparatus of claim 1, including a plurality of launch tube means, arranged circumferentially around the interior of the carrier missile, forming a launch tube array, wherein said launch tube means are each substantially parallel with the longitudinal axis of said carrier missile when in the stowed position.

8. An apparatus of claim 7, including a plurality of launch tube arrays arranged sequentially along the longitudinal axis of said carrier missile.

9. An apparatus of claim 6, wherein said support means is elongated, substantially hollow, and is positioned substantially central of said carrier missile.

10. An apparatus of claim 9, including means for preventing said actuator means from moving back toward the extended position after said actuator means has been returned to the start position from the extended position.

* * * * *